US009650698B2

(12) United States Patent
Hattendorf

(10) Patent No.: US 9,650,698 B2
(45) Date of Patent: May 16, 2017

(54) NICKEL-CHROMIUM ALLOY HAVING GOOD PROCESSABILITY, CREEP RESISTANCE AND CORROSION RESISTANCE

(71) Applicant: VDM Metals International GmbH, Werdohl (DE)

(72) Inventor: Heike Hattendorf, Werdohl (DE)

(73) Assignee: VDM Metals International GmbH, Werdohl (DE)

( * ) Notice: Subject to any disclaimer, the term of this patent is extended or adjusted under 35 U.S.C. 154(b) by 372 days.

(21) Appl. No.: 14/389,497

(22) PCT Filed: May 15, 2013

(86) PCT No.: PCT/DE2013/000269

§ 371 (c)(1),
(2) Date: Sep. 30, 2014

(87) PCT Pub. No.: WO2013/182178

PCT Pub. Date: Dec. 12, 2013

(65) Prior Publication Data

US 2015/0093288 A1 Apr. 2, 2015

(30) Foreign Application Priority Data

Jun. 5, 2012 (DE) ..... 10 2012 011 162

(51) Int. Cl.

| | |
|---|---|
| ***C22C 19/05*** | (2006.01) |
| ***C22C 30/00*** | (2006.01) |
| ***C22F 1/10*** | (2006.01) |

(52) U.S. Cl.

CPC ..... *C22C 19/055* (2013.01); *C22C 19/053* (2013.01); *C22C 19/058* (2013.01); *C22C 30/00* (2013.01); *C22F 1/10* (2013.01)

(58) Field of Classification Search

CPC ... C22C 19/055; C22C 19/053; C22C 19/058; C22C 30/00; C22F 1/10

See application file for complete search history.

(56) References Cited

U.S. PATENT DOCUMENTS

| | | | |
|---|---|---|---|
| 4,882,125 | A | 11/1989 | Smith et al. |
| 5,543,109 | A | 8/1996 | Senba et al. |
| 5,980,821 | A | 11/1999 | Brill |
| 5,997,809 | A | 12/1999 | Smith et al. |
| 6,458,318 | B1 | 10/2002 | Nishiyama et al. |
| 6,623,869 | B1 | 9/2003 | Nishiyama et al. |
| 6,852,177 | B2 | 2/2005 | Kubota et al. |
| 8,470,106 | B2 | 6/2013 | Cloue et al. |
| 8,568,901 | B2 | 10/2013 | Kiser et al. |
| 8,696,836 | B2 | 4/2014 | Takahata et al. |
| 9,249,482 | B2 | 2/2016 | Jakobi et al. |
| 2005/0129567 | A1 | 6/2005 | Kirchheiner et al. |
| 2006/0207696 | A1 | 9/2006 | Takahata et al. |
| 2010/0166594 | A1* | 7/2010 | Hirata ..... C21D 6/001 420/443 |
| 2016/0108501 | A1 | 4/2016 | Jakobi et al. |

FOREIGN PATENT DOCUMENTS

| | | | |
|---|---|---|---|
| CN | 1463296 | A | 12/2003 |
| CN | 1742106 | A | 3/2006 |
| CN | 1831165 | A | 9/2006 |
| CN | 101600814 | A | 12/2009 |
| DE | 600 04 737 | T2 | 6/2004 |
| EA | 201170560 | A1 | 12/2011 |
| EP | 0 508 058 | A1 | 10/1992 |
| EP | 0 549 286 | A1 | 6/1993 |
| EP | 1 698 708 | A1 | 9/2006 |
| JP | H01-312051 | A | 12/1989 |
| JP | H07-11366 | A | 1/1995 |
| JP | H07-216511 | A | 8/1995 |
| JP | H08-127848 | A | 5/1996 |
| JP | 2002-003970 | A | 1/2002 |
| JP | 2002-531709 | A | 9/2002 |
| JP | 2003-073763 | A | 3/2003 |
| JP | 2003-138334 | A | 5/2003 |
| JP | 2009-052084 | A | 3/2009 |
| JP | 2010-510074 | A | 4/2010 |
| JP | 2011121088 | A | 6/2011 |
| RU | 2125110 | C1 | 1/1999 |

OTHER PUBLICATIONS

International Search Report of PCT/DE2013/000269, mailed Nov. 11, 2013.

Grabke et al: "Metal dusting of nickel-base alloys", Materials and Corrosion 47, (1996), pp. 495-504.

Hermse et al: "Metal dusting: relationship between alloy composition and degradation rate", Corrosion Engineering, Science and Technology 2009, vol. 44, No. 3, pp. 182-185.

Slevolden et al: Tjeldbergodden Methanol Plant: Metal Dusting Investigations, NACE International Corrosion 2011 Conference & Expo, Paper No. 11144, pp. 1-15 (2011).

Buergel, Handbuch Hochtemperatur-Werkstofftechnik, Vieweg VEriag, Wiesbaden, 2006, pp. 358-374.

(Continued)

*Primary Examiner* — Jessee Roe

(74) *Attorney, Agent, or Firm* — Collard & Roe, P.C.

(57) ABSTRACT

The invention relates to a nickel-chromium alloy comprising (in wt.-%) 29 to 37% chromium, 0.001 to 1.8% aluminum, 0.10 to 7.0% iron, 0.001 to 0.50% silicon, 0.005 to 2.0% manganese, 0.00 to 1.00% titanium and/or 0.00 to 1.10% niobium, 0.0002 to 0.05% each of magnesium and/or calcium, 0.005 to 12% carbon, 0.001 to 0.050% nitrogen, 0.001 to 0.030% phosphorus, 0.0001 to 0.020% oxygen, not more than 0.010% sulfur, not more than 2.0% molybdenum, not more than 2.0% tungsten, the remainder nickel and the usual process-related impurities, wherein the following relations must be satisfied: $Cr+Al \geq 30$ (2a) and $Fp \leq 39.9$ (3a) with $Fp=Cr+0.272*Fe+2.36*Al+2.22*Si+2.48*Ti+0.374*Mo+0.538*W-11.8*C$ (4a), wherein Cr, Fe, Al, Si, Ti, Mo, W and C is the concentration of the respective elements in % by mass.

21 Claims, 4 Drawing Sheets

(56) References Cited

OTHER PUBLICATIONS

Figure 1:
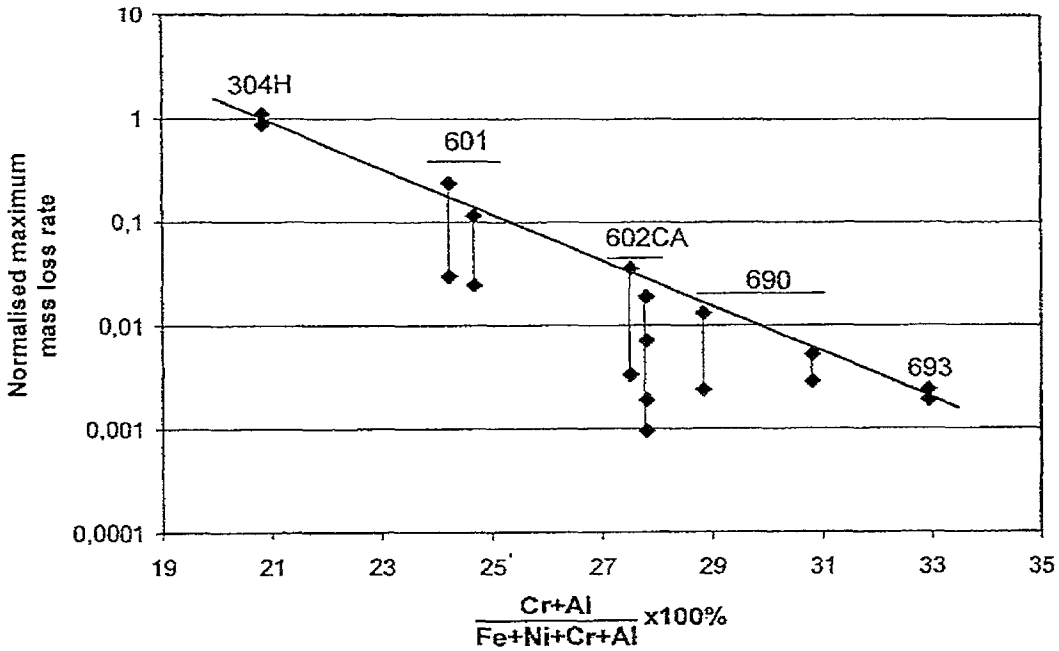

INCONEL alloy 690, Oct. 9, 2009, XP055085643, Url:http://www.specialmetals.com/documents/Inconelalloy690.pdf, pp. 1-8.
INCONEL R Alloy 693—Excellent Resistance to Metal Dusting and High Temperature Corrosion, internet citation, Nov. 17, 2004, URL:http://www.specialmetals.com/documents/Inconel%2Oalloy %2020693.pdf, pp. 1-8.
Baker et al: 02394, Nickel-Base Material Solutions to Metal Dusting Problems, 2002 NACE Conference papers (NACE International), Jan. 2, 2002, URL:http://www.asminternational.org/portal/site/www/AsmStore/ProductDEtals/?vgnetoid= 3c2ee604e3d33210VgnVcM100000701e010aRCR, 16 pages.
DIN EN ISO 6892-1, Metallic materials—Tensile testing—Part 1: Method of test at room temperature, First edition Aug. 15, 2009.
DIN EN ISO 6892-2, Metallic materials—Tensile testing—Part 2: Method of test at elevated temperature, May 2011.
International Search Report of PCT/DE2013/000268, mailed Nov. 6, 2013.
R. T. Holt et al: "Impurities and trace elements in nickel-base superalloys", International Materials Reviews, Review 203, (Mar. 1976), pp. 1-24.

* cited by examiner

NICKEL-CHROMIUM ALLOY HAVING GOOD PROCESSABILITY, CREEP RESISTANCE AND CORROSION RESISTANCE

CROSS REFERENCE TO RELATED APPLICATIONS

This application is the National Stage of PCT/DE2013/000269 filed on May 15, 2013, which claims priority under 35 U.S.C. §119 of German Application No. 10 2012 011 162.2 filed on Jun. 5, 2012, the disclosure of which is incorporated by reference. The international application under PCT article 21(2) was not published in English.

The invention relates to a nickel-chromium alloy with good high-temperature corrosion resistance, good creep resistance and improved processability.

Nickel alloys with different nickel, chromium and aluminum contents have long been used in furnace construction and in the chemical as well as petrochemical industry. For this use, a good high-temperature corrosion resistance even in carburizing atmospheres and a good heat resistance/creep resistance are necessary.

In general, it may be remarked that the high-temperature corrosion resistance of the alloys listed in Table 1 increases with increasing chromium content. All these alloys form a chromium oxide layer ($Cr_2O_3$) with an underlying, more or less closed $Al_2O_3$ layer. Small additions of strongly oxygen-affine elements such as, e.g. Y or Ce improve the oxidation resistance. The chromium content is slowly consumed for build-up of the protecting layer in the course of use in the application zone. Therefore the lifetime of the material is prolonged by a higher chromium content, since a higher content of the element chromium forming the protective layer extends the time at which the Cr content lies below the critical limit and oxides other than $Cr_2O_3$ are formed, which are, e.g. iron-containing and nickel-containing oxides. A further increase of the high-temperature corrosion resistance could be achieved if necessary by additions of aluminum and silicon. Starting from a certain minimum content, these elements form a closed layer under the chromium oxide layer and thus reduce the consumption of chromium.

In carburizing atmospheres (CO, $H_2$, $CH_4$, $CO_2$, $H_2O$ mixtures), carbon may penetrate into the material, and so the formation of internal carbides may take place. These cause a loss of notch impact toughness. Also, the melting point may sink to very low values (down to 350° C.) and transformation processes may occur due to chromium depletion in the matrix.

A high resistance to carburization is achieved by materials with low solubility for carbon and low rate of diffusion of the carbon. In general, therefore, nickel alloys are more resistant to carburization than iron-base alloys, since both the diffusion of carbon and also the solubility of carbon in nickel are smaller than in iron. An increase of the chromium content brings about a higher carburization resistance by formation of a protecting chromium oxide layer, unless the oxygen partial pressure in the gas is not sufficient for the formation of this protecting chromium oxide layer. At very low oxygen partial pressure, it is possible to use materials that form a layer of silicon oxide or of the even more stable aluminum oxide, both of which are still able to form protecting oxide layers at much lower oxygen contents.

In the case that the carbon activity is >1, the so-called "metal dusting" may occur in alloys based on nickel, iron or cobalt. In contact with the supersaturated gas, the alloys may absorb large amounts of carbon. The segregation processes taking place in the alloy supersaturated with carbon leads to material destruction. In the process, the alloy decomposes into a mixture of metal particles, graphite, carbides and/or oxides. This type of material destruction takes place in the temperature range from 500° C. to 750° C.

Typical conditions for the occurrence of metal dusting are strongly carburizing CO, $H_2$ or $CH_4$ gas mixtures, such as occur in the synthesis of ammonia, in methanol plants, in metallurgical processes but also in hardening furnaces.

The resistance to metal dusting tends to increase with increasing nickel content of the alloy (Grabke, H. J., Krajak, R., Müller-Lorenz, E. M., Strauss, S.: Materials and Corrosion 47 (1996), p. 495), although even nickel alloys are not generally resistant to metal dusting.

The chromium and the aluminum content have a distinct influence on the corrosion resistance under metal dusting conditions (see FIG. 1). Nickel alloys with low chromium content (such as the Alloy 600 alloy, see Table 1) exhibit comparatively high corrosion rates under metal dusting conditions. The Alloy 602 CA (N06025) nickel alloy, with a chromium content of 25% and an aluminum content of 2.3% as well as Alloy 690 (N06690), with a chromium content of 30% (Hermse, C. G. M. and van Wortel, J. C.: Metal dusting: relationship between alloy composition and degradation rate. Corrosion Engineering, Science and Technology 44 (2009), p. 182-185), are much more resistant. The resistance to metal dusting increases with the sum of Cr+Al.

The heat resistance or creep resistance at the indicated temperatures is improved by a high carbon content among other factors. However, high contents of solid-solution-strengthening elements such as chromium, aluminum, silicon, molybdenum and tungsten improve the heat resistance. In the range of 500° C. to 900° C., additions of aluminum, titanium and/or niobium can improve the resistance, and specifically by precipitation of the γ' and/or γ" phase.

Examples according to the prior art are listed in Table 1.

Alloys such as Alloy 602 CA (N06025), Alloy 693 (N06693) or Alloy 603 (N06603) are known for their excellent corrosion resistance in comparison with Alloy 600 (N06600) or Alloy 601 (N06601) by virtue of the high aluminum content of more than 1.8%. Alloy 602 CA (N06025), Alloy 693 (N06693), Alloy 603 (N06603) and Alloy 690 (N06690) exhibit excellent carburization resistance or metal dusting resistance by virtue of their high chromium and/or aluminum contents. At the same time, by virtue of the high carbon or aluminum content, alloys such as Alloy 602 CA (N06025), Alloy 693 (N06693) or Alloy 603 (N06603) have excellent heat resistance or creep resistance in the temperature range in which metal dusting occurs. Alloy 602 CA (N06025) and Alloy 603 (N06603) still have excellent heat resistance or creep resistance even at temperatures above 1000° C. Because of, for example, the high aluminum content, however, the processability is impaired, and the impairment is greater the higher the aluminum content (Alloy 693-N06693). The same is true to a greater extent for silicon, which forms low-melting intermetallic phases with nickel. In Alloy 602 CA (N06025) or Alloy 603 (N06603), the cold formability in particular is limited by the high proportion of primary carbides.

U.S. Pat. No. 6,623,869 B1 discloses a metallic material that consists of ≤0.2% C, 0.01-4% Si, 0.05-2.0% Mn, ≤0.04% P, ≤0.015% S, 10-35% Cr, 30-78% Ni, 0.005-4.5% Al, 0.005-0.2% N and at least one element 0.015-3% Cu or 0.015-3% Co, with the rest up to 100% iron. Therein the value of 40Si+Ni+5Al+40N+10(Cu+Co) is not smaller than 50, where the symbols of the elements denote the fractional content of the corresponding elements. The material has an excellent corrosion resistance in an environment in which metal dusting can occur and it may therefore be used for furnace pipes, pipe systems, heat-exchanger tubes and the like in petroleum refineries or petrochemical plants, and it can markedly improve the lifetime and safety of the plant.

EP 0 549 286 discloses a high-temperature-resistant Ni—Cr alloy containing 55-65% Ni, 19-25% Cr, 1-4.5% Al, 0.045-0.3% Y, 0.15-1% Ti, 0.005-0.5% C, 0.1-1.5% Si, 0-1% Mn and at least 0.005% in total of at least one of the elements of the group containing Mg, Ca, Ce, <0.5% in total of Mg+Ca, <1% Ce, 0.0001-0.1% B, 0-0.5% Zr, 0.0001-0.2% N, 0-10% Co, 0-0.5% Cu, 0-0.5% Mo, 0-0.3% Nb, 0-0.1% V, 0-0.1% W, the rest iron and impurities.

The task underlying the invention consists in designing a nickel-chromium alloy that exceeds the metal dusting resistance of Alloy 690, so that an excellent metal dusting resistance is assured, but which at the same time exhibits a good phase stability a good processability a good corrosion resistance in air, similar to that of Alloy 601 or Alloy 690.

Furthermore, it would be desirable if this alloy additionally had a good heat resistance/creep resistance.

This task is accomplished by a nickel-chromium alloy with (in % by wt) 29 to 37% chromium 0.001 to 1.8% aluminum, 0.10 to 7.0% iron, 0.001 to 0.50% silicon, 0.005 to 2.0% manganese, 0.00 to 1.00% titanium and/or 0.00 to 1.10% niobium, respectively 0.0002 to 0.05% magnesium and/or calcium, 0.005 to 0.12% carbon, 0.001 to 0.050% nitrogen, 0.001 to 0.030% phosphorus, 0.0001-0.020% oxygen, max. 0.010% sulfur, max. 2.0% molybdenum, max. 2.0% tungsten, the rest nickel and the usual process-related impurities, wherein the following relationships must be satisfied:

$$Cr+Al>30 \quad (2a)$$

$$\text{and } Fp \leq 39.9 \text{ with} \quad (3a)$$

$$Fp=Cr+0.272*Fe+2.36*Al+2.22*Si+2.48*Ti+1.26*Nb+0.374*Mo+0.538*W-11.8*C \quad (4a)$$

where Cr, Fe, Al, Si, Ti, Nb, Mo, W and C are the concentrations of the elements in question in % by mass.

Advantageous further embodiments of the subject matter of the invention are also described in the disclosure.

The spread for the element chromium lies between 29 and 37%, wherein preferred ranges may be adjusted as follows:

30 to 37%

31 to 37%

31 to 36%

32 to 35%

32 to 36%

>32 to 37%

The aluminum content lies between 0.001 and 1.8%, wherein here also preferred aluminum contents may be adjusted as follows depending on the field of use of the alloy:

0.001 to 1.4%

0.001 to 1.3%

0.001 to <1.0%

0.001 to 0.60%

0.01 to 0.60%

0.10 to 0.60%

0.20 to 0.60%

The iron content lies between 0.1 and 7.0%, wherein defined contents may be adjusted within the following spread depending on the area of application:

0.1-4.0%

0.1-3.0%

0.1-<2.5%

0.1-2.0%

0.1-1.0%

The silicon content lies between 0.001 and 0.50%. Preferably Si may be adjusted in the alloy within the spread as follows:

0.001-0.20%

0.001-<0.10%

0.001-<0.05%

0.01-<0.20%

The same is true for the element manganese, which may be contained in proportions of 0.005 to 2.0% in the alloy. Alternatively, the following spread is also conceivable:

0.005-0.50%

0.005-0.20%

0.005-0.10%

0.005-<0.05%

0.01-<0.20%

The titanium content lies between 0.00 and 1.0%. Preferably Ti may be adjusted within the spread as follows in the alloy:

0.001-<1.00%

0.001-0.60%

0.001-0.50%

0.01-0.50%

0.10-0.50%

0.10-0.40%

The Nb content lies between 0.00 and 1.1%. Preferably Nb may be adjusted within the spread as follows in the alloy:

0.001-1.0%

0.001-<0.70%

0.001-<0.50%

0.001-0.30%

0.01-0.30%

0.10-1.10%.

0.20-0.80%.

0.20-0.50%.

0.25-0.45%.

Magnesium and/or calcium is also contained in contents of 0.0002 to 0.05%. Preferably the possibility exists of adjusting these elements respectively as follows in the alloy:

0.0002-0.03%

0.0002-0.02%

0.0005-0.02%.

0.001-0.02%.

The alloy contains 0.005 to 0.12% carbon. Preferably this may be adjusted within the spread as follows in the alloy:

0.01-0.12%

0.02-0.12%

0.03-0.12%

0.05-0.12%

0.05-0.10%

This is true in the same way for the element nitrogen, which is contained in contents between 0.001 and 0.05%. Preferred contents may be stated as follows:

0.003-0.04%

The alloy further contains phosphorus in contents between 0.001 and 0.030%. Preferred contents may be stated as follows:

0.001-0.020%

The alloy further contains oxygen in contents between 0.0001 and 0.020%, containing especially 0.0001 to 0.010%.

The element sulfur is specified as follows in the alloy:

max. 0.010%

Molybdenum and tungsten are contained individually or in combination in the alloy in a content of respectively at most 2.0%. Preferred contents may be stated as follows:

Mo max. 1.0%
W max. 1.0%
Mo max. <0.50%
W max. <0.50%
Mo max. <0.05%
W max. <0.05%

The following relationship between Cr and Al must be satisfied, so that a sufficient resistance to metal dusting is achieved:

$$Cr+Al>30 \quad (2a)$$

where Cr and Al are the concentrations of the elements in question in % by mass.

Preferred ranges may be adjusted with $$Cr+Al\geq 31 \quad (2b)$$

Furthermore the following relationship must be satisfied, so that a sufficient phase stability is achieved:

$$Fp\leq 39.9 \text{ with} \quad (3a)$$

$$Fp=Cr+0.272*Fe+2.36*Al+2.22*Si+2.48*Ti+1.26*Nb+0.374*Mo+0.538*W-11.8*C \quad (4a)$$

where Cr, Fe, Al, Si, Ti, Nb, Mo, W and C are the concentrations of the elements in question in % by mass.

Preferred ranges may be adjusted with:

$$Fp\leq 38.4 \quad (3b)$$

$$Fp\leq 36.6 \quad (3c)$$

Optionally the element yttrium may be adjusted in contents of 0.01 to 0.20% in the alloy. Preferably Y may be adjusted within the spread as follows in the alloy:

0.01-0.15%
0.01-0.10%
0.01-0.08%
0.01-0.05%
0.01-<0.045%

Optionally the element lanthanum may be adjusted in contents of 0.001 to 0.20% in the alloy. Preferably La may be adjusted within the spread as follows in the alloy:

0.001-0.15%
0.001-0.10%
0.001-0.08%
0.001-0.05%
0.01-0.05%

Optionally the element Ce may be adjusted in contents of 0.001 to 0.20% in the alloy. Preferably Ce may be adjusted within the spread as follows in the alloy:

0.001-0.15%
0.001-0.10%
0.001-0.08%
0.001-0.05%
0.01-0.05%

Optionally, in the case of simultaneous addition of Ce and La, cerium mixed metal may also be used in contents of 0.001 to 0.20%. Preferably cerium mixed metal may be adjusted within the spread as follows in the alloy:

0.001-0.15%
0.001-0.10%
0.001-0.08%
0.001-0.05%
0.01-0.05%

If necessary, Zr may also be added to the alloy. The zirconium content lies between 0.01 and 0.20%. Preferably Zr may be adjusted within the spread as follows in the alloy:

0.01-0.15%
0.01-<0.10%
0.01-0.07%
0.01-0.05%

Optionally, zirconium may be replaced completely or partly by 0.001-0.2% hafnium.

Optionally, 0.001 to 0.60% tantalum may also be contained in the alloy.

Optionally, the element boron may be contained as follows in the alloy:

0.0001-0.008%

Preferably, contents of boron may be stated as follows:

0.0005-0.008%
0.0005-0.004%

Furthermore, the alloy may contain between 0.00 and 5.0% cobalt if necessary, which furthermore may be limited even more as follows:

0.01 to 5.0%
0.01 to 2.0%
0.1 to 2.0%
0.01 to 0.5%

Furthermore, at most 0.5% Cu may be contained in the alloy if necessary.

The copper content may be further restricted as follows:

max. <0.05%
max. <0.015%

If Cu is contained in the alloy, Formula 4a must be supplemented with a term for Cu as follows:

$$Fp=Cr+0.272*Fe+2.36*Al+2.22*Si+2.48*Ti+1.26*Nb+0.477*Cu+0.374*Mo+0.538*W-11.8*C \quad (4b)$$

where Cr, Fe, Al, Si, Ti, Nb, Cu, Mo, W and C are the concentrations of the elements in question in % by mass.

Furthermore, at most 0.5% vanadium may be contained in the alloy if necessary.

Finally, the elements lead, zinc and tin may be stated as impurities in contents as follows:

Pb max. 0.002%
Zn max. 0.002%
Sn max. 0.002%

Furthermore, the following relationship, which assures a particularly good processability, may be satisfied:

$$Fa\leq 60 \text{ with} \quad (5a)$$

$$Fa=Cr+6.15*Nb+20.4*Ti+201*C \quad (6a)$$

where Cr, Ti, Nb and C are the concentrations of the elements in question in % by mass.

Preferred ranges may be adjusted with:

$$Fa\geq 54 \quad (5b)$$

Furthermore, the following relationship, which describes a particularly good heat resistance or creep resistance, may be satisfied:

$$Fk \geq 40 \text{ with} \quad (7a)$$

$$Fk = Cr+19*Ti+34.3*Nb+10.2*Al+12.5*Si+98*C \quad (8a)$$

where Cr, Ti, Nb, Al, Si and C are the concentrations of the elements in question in % by mass.

Preferred ranges may be adjusted with:

$$Fk \geq 45 \quad (7b)$$

$$Fk \geq 49 \quad (7c)$$

If boron is contained in the alloy, Formula 6a must be supplemented with a term for boron as follows:

$$Fk = Cr+19*Ti+34.3*Nb+10.2*A+12.5*Si+98*C+2245*B \quad (8b)$$

where Cr, Ti, Nb, Al, Si, C and B are the concentrations of the elements in question in % by mass.

The alloy according to the invention is preferably smelted in an open system, followed by a treatment in a VOD or VLF system. However, a smelting and pouring in vacuum is also possible. Thereafter the alloy is cast in ingots or as continuous strand. If necessary, the ingot is then annealed for 0.1 h to 70 h at temperatures between 900° C. and 1270° C. Furthermore, it is possible to remelt the alloy additionally with ESU and/or VAR. Thereafter the alloy is worked into the desired semifinished product shape. For this it is annealed if necessary for 0.1 h to 70 h at temperatures between 900° C. and 1270° C., then hot-formed, if necessary with intermediate annealings for 0.05 h to 70 h between 900° C. and 1270° C. If necessary, the surface of the material may also be milled chemically and/or mechanically occasionally (even several times) and/or at the end for cleaning. After the end of hot shaping, cold shaping to the desired semifinished product shape with reduction ratios up to 98% may take place if necessary, with intermediate annealings for 0.1 min to 70 h between 700° C. and 1250° C. if necessary, under shielding gas, if necessary, such as argon or hydrogen, for example, followed by cooling in air, in the agitated annealing atmosphere or in the water bath. Thereafter a solution annealing takes place for 0.1 min to 70 h between 700° C. and 1250° C., under shielding gas, if necessary, such as argon or hydrogen, for example, followed by cooling in air, in the agitated annealing atmosphere or in the water bath. If necessary, chemical and/or mechanical cleanings of the material surface may take place occasionally and/or after the last annealing.

The alloy according to the invention can be readily manufactured and used in the product forms of strip, sheet, bar, wire, longitudinally seam-welded pipe and seamless pipe.

These product forms are manufactured with a mean grain size of 5 μm to 600 μm. The preferred grain-size range lies between 20 μm and 200 μm.

The alloy according to the invention will preferably be used in zones in which carburizing conditions prevail, such as, for example, in structural parts, especially pipes, in the petrochemical industry. Furthermore, it is also suitable for furnace construction.

Tests Performed:

The phases occurring at equilibrium were calculated for the different alloy variants with the JMatPro program of Thermotech. The TTNI7 database of Thermotech for nickel-base alloys was used as the database for the calculations.

The formability is determined in a tension test according to DIN EN ISO 6892-1 at room temperature. Therein the yield strength $R_{p0.2}$, the tensile strength $R_m$ and the elongation A at break are determined. The elongation A is determined on the broken specimen from the elongation of the original gauge length $L_0$:

$$A=(L_u-L_0)/L_0 100\% = \Delta L/L_0 100\%$$

where $L_u$=measured length after break.

Depending on gauge length, the elongation at break is characterized by indices:

For example, for $A_5$ the gauge length is $L_0=5 \cdot d_0$, where $d_0$=initial diameter of a round specimen.

The tests were performed on round specimens with a diameter of 6 mm in the measurement zone and a gauge length $L_0$ of 30 mm. The sampling took place transversely relative to the forming direction of the semifinished product. The deformation rate was 10 MPa/s for $R_{p0.2}$ and 6.7 $10^{-3}$ l/s (40%/min) for $R_m$.

The magnitude of the elongation A in the tension test at room temperature may be taken as a measure of the deformability. A readily processable material should have an elongation of at least 50%.

The heat resistance is determined in a hot tension test according to DIN EN ISO 6892-2. Therein the yield strength $R_{p0.2}$, the tensile strength $R_m$ and the elongation A at break are determined by analogy with the tension test at room temperature (DIN EN ISO 6892-1).

The tests were performed on round specimens with a diameter of 6 mm in the measurement zone and an initial gauge length $L_0$ of 30 mm. The sampling took place transversely relative to the forming direction of the semifinished product. The deformation rate was 8.33 $10^{-5}$ l/s (0.5%/min) for $R_{p0.2}$ and 8.33 $10^{-4}$ l/s (5%/min) for $R_m$.

The specimen is mounted at room temperature in a tension testing machine and heated without loading by a tensile force to the desired temperature. After reaching the test temperature, the specimen is held without loading for one hour (600° C.) or two hours (700° C. to 1100° C.) for temperature equilibration. Thereafter the specimen is loaded with tensile force in such a way that the desired strain rates are maintained, and the test begins.

The creep resistance of a material improves with increasing heat resistance. Therefore the heat resistance is also used for appraisal of the creep resistance of the various materials.

The corrosion resistance at elevated temperatures was determined in an oxidation test at 1000° C. in air, wherein the test was interrupted every 96 hours and the dimensional changes of the specimens due to oxidation were determined. The specimens were placed in ceramic crucibles during the test, so that any oxide that may have spalled was collected and the mass of the spalled oxide can be determined by weighing the crucible containing the oxides. The sum of the mass of the spalled oxide and of the change in mass of the specimens is the gross change in mass of the respective specimen. The specific change in mass is the change in mass relative to the surface area of the specimens. Hereinafter these are denoted by $m_{net}$ for the specific change in net mass, $m_{gross}$ for the specific change in gross mass, $m_{spall}$ for the specific change in mass of the spalled oxides. The tests were carried out on specimens of approximately 5 mm thickness. Three specimens were extracted from each batch, and the reported values are the mean values of these 3 specimens.

Description of the Properties

In addition to an excellent metal dusting resistance, the alloy according to the invention should also have the following properties:

a good phase stability a good processability a good corrosion resistance in air, similar to that of Alloy 601 or Alloy 690.

Also desirable is a good heat resistance/creep resistance.

Phase Stability

In the nickel-chromium-aluminum-iron system with additions of Ti and/or Nb, various embrittling TCP phases such as, for example, the Laves phases, sigma phases or the μ-phases as well as also the embrittling η-phase or ϵ-phases can be formed, depending on alloying contents (see, for example, Ralf Bürgel, Handbook of High-Temperature Materials Engineering [in German], 3rd Edition, Vieweg Verlag, Wiesbaden, 2006, page 370-374). The calculation of the equilibrium phase fractions as a function of temperature, for example of N06690, the batch 111389 (see Table 2, typical compositions) shows theoretically the formation of α-chromium (BCC phase in FIG. 2) below 720° C. ($T_{s\ BCC}$) in large proportions. However, this phase is formed only with difficulty, because it is analytically very different from the base material. Nevertheless, if the formation temperature $T_{s\ BCC}$ of this phase is very high, it can definitely occur, as is described, for example, in E. Slevolden, J. Z. Albertsen, U. Fink "Tjeldbergodden Methanol Plant: Metal Dusting Investigations," Corrosion/2011, paper no. 11144 (Houston, Tex.: NACE 2011), p. 15" for a variant of Alloy 693 (UNS 06693). This phase is brittle and leads to an undesired embrittlement of the material.

Figure 3:
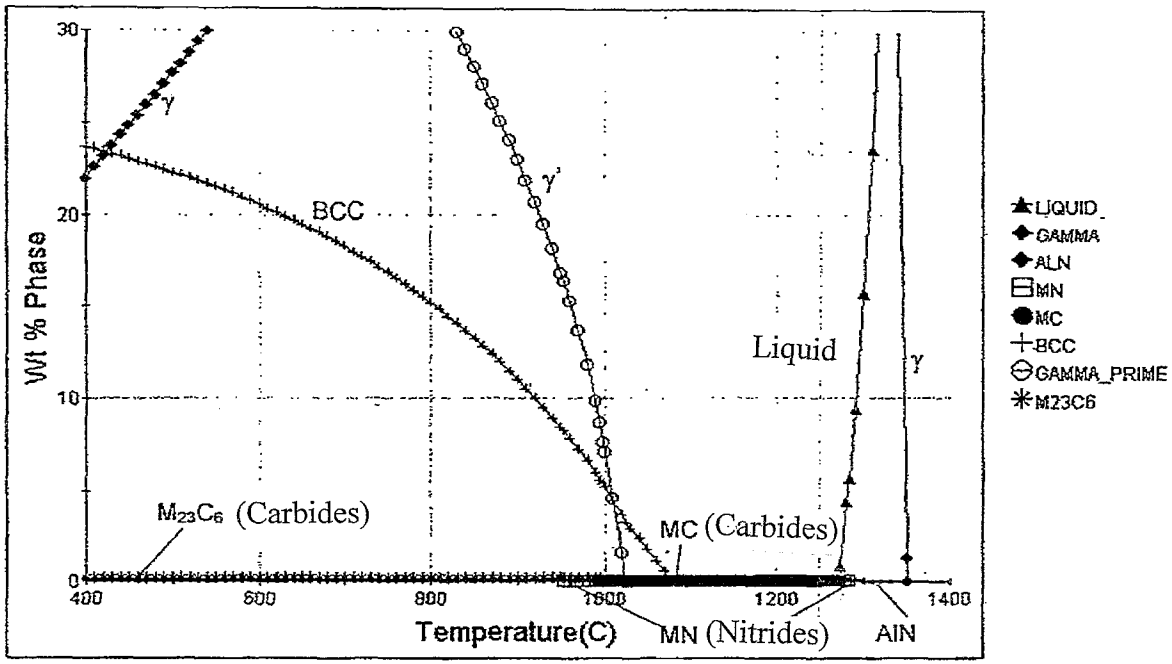
Figure 4:
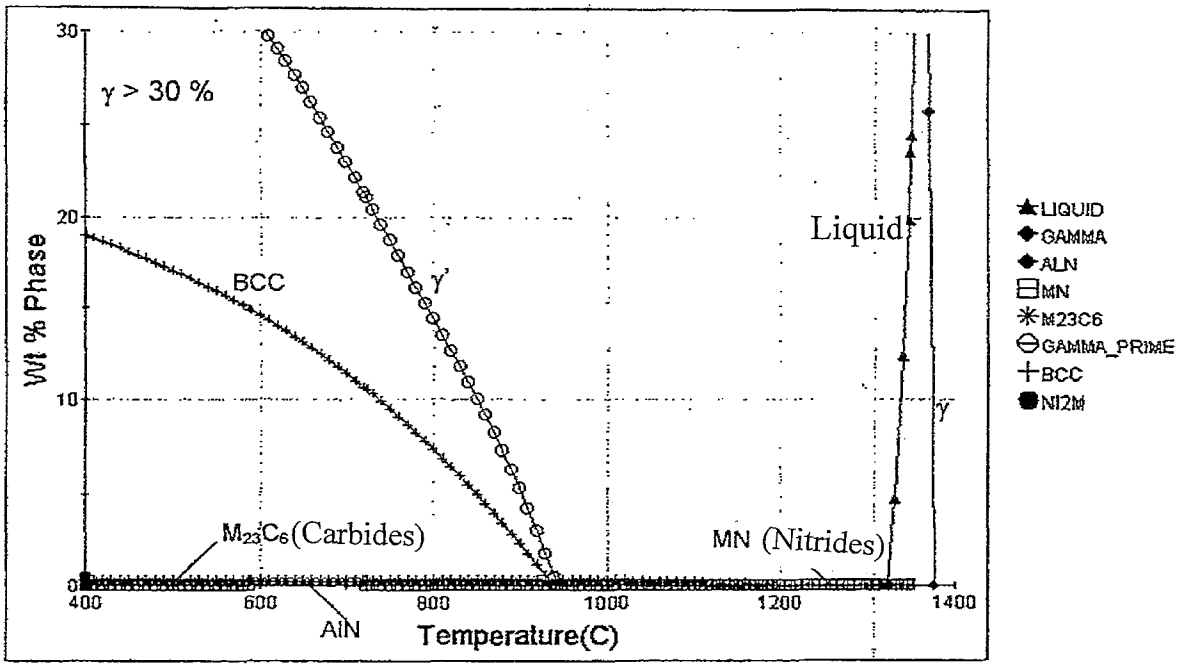

FIG. 3 and FIG. 4 show the phase diagrams of the Alloy 693 variants (from U.S. Pat. No. 4,882,125 Table 1) Alloy 3 and Alloy 10 from Table 2. Alloy 3 has a formation temperature $T_{s\ BCC}$ of 1079° C., Alloy 10 of 939° C. In E. Slevolden, J. Z. Albertsen, U. Fink "Tjeldbergodden Methanol Plant: Metal Dusting Investigations," Corrosion/2011, paper no. 11144 (Houston, Tex.: NACE 2011), p. 15", the exact analysis of the alloy in which the α-chromium (BCC) occurs is not described. Nevertheless, it can be assumed that, among the examples presented in Table 2 for Alloy 693, α-chromium (BCC phase) can be formed in the analyses that theoretically have the highest formation temperatures $T_{s\ BCC}$ (such as Alloy 10, for example). In a corrected analysis (with reduced formation temperature $T_{s\ BCC}$), α-chromium was observed only in the proximity of the surface in E. Slevolden, J. Z. Albertsen, U. Fink "Tjeldbergodden Methanol Plant: Metal Dusting Investigations," Corrosion/2011, paper no. 11144 (Houston, Tex.: NACE 2011), p. 15". To avoid the occurrence of such an embrittling phase, the formation temperature in the alloys according to the invention should be $T_{s\ BCC} \leq 939°$ C.—which is the lowest formation temperature $T_{s\ BCC}$ among the examples for Alloy 693 in Table 2 (from U.S. Pat. No. 4,882,125 Table 1).

This is the case in particular when the following formula is satisfied:

$$Fp \leq 39.9 \text{ with} \tag{3a}$$

$$Fp = Cr + 0.272*Fe + 2.36*AI + 2.22*Si + 2.48*Ti + 1.26*Nb + 0.374*Mo + 0.538*W - 11.8*C \tag{4a}$$

where Cr, Al, Fe, Si, Ti, Nb, Mo, W and C are the concentrations of the elements in question in % by mass. Table 2 with the alloys according to the prior art shows that Fp for Alloy 8, Alloy 3 and Alloy 2 is >39.9 and for Alloy 10 is exactly 39.9. For all other alloys with $T_{s\ BCC} \leq 939°$ C., Fp is ≤39.9.

Processability

The formability will be considered here as an example of processability.

An alloy can be hardened by several mechanisms, so that it has a high heat resistance or creep resistance. Thus the alloying addition of another element brings about a more or less large increase of the strength (solid-solution hardening), depending on element. An increase of the strength by fine particles or precipitates (precipitation hardening) is far more effective. This may take place, for example, by the γ'-phase, which is formed by additions of Al and further elements, such as, for example: Ti to a nickel alloy, or by carbides, which are formed by addition of carbon to a chromium-containing nickel alloy (see, for example, Ralf Bürgel, Handbook of High-Temperature Materials Engineering, 3rd Edition, Vieweg Verlag, Wiesbaden, 2006, page 358-369).

The increase of the content of elements forming the γ'-phase, or of the C content, indeed increases the heat resistance, but increasingly impairs the formability, even in the solution-annealed condition.

For a very readily formable material, elongations A5 of ≥50% but at least ≥45% are desired in the tension test at room temperature.

This is achieved in particular when the following relationship between the elements Cr, Nb, Ti and C forming the carbide is satisfied:

$$Fa \leq 60 \text{ with} \tag{5a}$$

$$Fa = Cr + 6.15*Nb + 20.4*Ti + 201*C \tag{6b}$$

where Cr, Nb, Ti and C are the concentrations of the elements in question in % by mass.

Heat Resistance/Creep Resistance

The chromium content in the alloy according to the invention is stated as ≥29%, preferably ≥30% or ≥31%. To ensure phase stability at such high chromium contents, the aluminum content has been chosen more in the lower range as ≤1.8%, preferably ≤1.4%. However, since the aluminum content contributes substantially to the tensile strength or creep resistance (both by solid-solution hardening and also by γ' hardening), this has the consequence that the target for the heat resistance or the creep resistance was taken not as that of Alloy 602 CA but instead that of Alloy 601, even though much higher values for the heat resistance and creep resistance naturally would be desirable.

It was desired that the yield strength or the tensile strength at higher temperatures lie at least in the range of the values of Alloy 601 or Alloy 690 (see Table 4). At least 3 of the 4 following relationships should be satisfied:

$$600° \text{ C.: yield strength } R_{p0.2} > 140 \text{ MPa; tensile strength } R_m > 450 \text{ MPa} \tag{7a, 7b}$$

$$800° \text{ C.: yield strength } R_{p0.2} > 130 \text{ MPa; tensile strength } R_m > 135 \text{ MPa} \tag{7c, 7d}$$

This is achieved in particular when the following relationship between the mainly hardening elements is satisfied:

$$Fk \geq 40 \text{ with} \tag{7a}$$

$$Fk = Cr + 19*Ti + 34.3*Nb + 10.2*Al + 12.5*Si + 98*C + 2245*B \tag{8b}$$

where Cr, Ti, Nb, Al, Si, C and B are the concentrations of the elements in question in % by mass.

Corrosion Resistance:

The oxidation resistance of a good chromium oxide builder is adequate. The alloy according to the invention should therefore have a corrosion resistance in air similar to that of Alloy 690 or Alloy 601.

EXAMPLES

Manufacture

Tables 3a and 3b show the analyses of the batches smelted on the laboratory scale together with some industrially smelted batches, cited for comparison, according to the prior art, of Alloy 602CA (N06025), Alloy 690 (N06690), Alloy 601 (N06601). The batches according to the prior art are marked with a T, those according to the invention with an E. The batches corresponding to the laboratory scale are marked with an L, those smelted industrially with a G.

The ingots of the alloys smelted in vacuum on the laboratory scale in Table 3a and b were annealed for 8 h between 900° C. and 1270° C. and hot-rolled to a final thickness of 13 mm or 6 mm by means of hot rolls and further intermediate annealings for 0.1 to 1 h between 900° C. and 1270° C. The sheets produced in this way were solution-annealed for 1 h between 900° C. and 1270° C. The specimens needed for the measurements were taken from these sheets.

For the industrially smelted alloys, a sample from the industrial production was taken from a commercially produced sheet of suitable thickness. The specimens needed for the measurements were taken from this sample.

All alloy variants typically had a grain size between 65 and 310 μm.

For the exemplary batches in Table 3a and 3b, the following properties were compared.

- Metal dusting resistance
- Phase stability
- Formability on the basis of the tension test at room temperature
- Heat resistance/creep resistance by means of hot tension tests
- Corrosion resistance by means of an oxidation test Batches 2294 to 2314 and 250053 to 250150 were smelted on the laboratory scale. The batches according to the invention marked with E satisfy the Formula (2a) with Cr+AI>30 and are therefore more resistant to metal dusting than is Alloy 690. Batches 2298, 2299, 2303, 2304, 2305, 2308, 2314, 250063, 260065, 250066, 250067, 250068, 250079, 250139, 250140 and 250141 satisfy formula (2b) AI+Cr≥31. They are therefore particularly resistant to metal dusting.

For the selected alloys according to the prior art in Table 2 and for all laboratory batches (Tables 3a and 3b), the phase diagrams were calculated and the formation temperature $T_{s\ BCC}$ was entered in Tables 2 and 3a. For the compositions in Tables 2 as well as 3a and 3b, the value for Fp according to Formula 4a was also calculated. Fp is larger the higher the formation temperature $T_{s\ BCC}$. All examples of Alloy 693 (N06693) with a formation temperature $T_{s\ BCC}$ higher than that of Alloy 10 have an Fp>39.9. The requirement Fp≤39.9 (Formula 3a) is therefore a good criterion for obtaining an adequate phase stability in an alloy. All laboratory batches (marking L) in Table 3a and 3b satisfy the criterion Fp≤39.9.

The yield strength $R_{p0.2}$, the tensile strength $R_m$ and the elongation $A_5$ for room temperature RT and for 600° C. are entered in Table 4, as is the tensile strength $R_m$ for 800° C. The values for Fa and Fk are also entered.

Exemplary batches 156817 and 160483 of the alloy according to the prior art, Alloy 602 CA in Table 4, have a comparatively small elongation A5 at room temperature of 36 or 42%, which fall short of the requirements for good formability. Fa is >60 and therefore above the range that characterizes good formability. All alloys according to the invention exhibit an elongation >50%. Thus they satisfy the requirements. Fa is <60 for all alloys according to the invention. They therefore lie in the range of good formability. The elongation is particularly high when Fa is comparatively small.

Exemplary batch 156658 of the alloy according to the prior art, Alloy 601 in Table 4, is an example of the range that the yield strength and tensile strength should reach at 600° C. and 800° C. This is described by the Formulas 7a to 7d. The value for Fk is >40. The alloys 2298, 2299, 2303, 2304, 2305, 2308, 2314, 250060, 250063, 260065, 250066, 250067, 250068, 250079, 250139, 250140, 250141, 250143, 250150 meet the requirement that at least 3 of the 4 Formulas 7a to 7d be satisfied. For these alloys, Fk is also larger than 40. The laboratory batches 2295, 2303, 250053, 250054 and 250057 are examples wherein fewer than 3 of the 4 Formulas 7a to 7d are satisfied. Then Fk is also <45.

Table 5 shows the specific changes in mass after an oxidation test at 1100° C. in air after 11 cycles of 96 h, i.e. a total of 1056 h. The gross change in mass, the net change in mass and the specific change in mass of the spalled oxides after 1056 h are indicated in Table 5. The alloys according to the prior art, Alloy 601 and Alloy 690, exhibited a much higher gross change in weight than Alloy 602 CA. This is due to the fact that, although Alloy 601 and Alloy 690 form a chromium oxide layer that grows faster than an aluminum oxide layer, Alloy 602 CA has an at least partly closed aluminum oxide layer under the chromium oxide layer. This reduces the growth of the oxide layer markedly and thus also the specific increase in mass. The alloys according to the invention should have a corrosion resistance in air similar to that of Alloy 690 or Alloy 601. This means that the gross change in mass should be smaller than 60 g/m$^2$. This is the case for all laboratory batches in Table 5, and therefore also for the batches according to the invention.

The claimed limits for the alloy "E" according to the invention can therefore be substantiated in detail as follows:

Too low Cr contents mean that the Cr concentration sinks very rapidly below the critical limit during use of the alloy in a corrosive atmosphere, and so a closed chromium oxide can no longer be formed. Therefore 29% Cr is the lower limit for chromium. Too high Cr contents impair the phase stability of the alloy. Therefore 37% Cr must be regarded as the upper limit.

A certain minimum aluminum content of 0.001% is necessary for the manufacturability of the alloy. Too high Al contents, especially in the case of very high chromium contents, impair the processability and the phase stability of the alloy. Therefore an Al content of 1.8% constitutes the upper limit.

The costs for the alloy rise with the reduction of the iron content. Below 0.1%, the costs rise disproportionately, since special raw material must be used. For cost reasons, therefore, 0.1% Fe must be regarded as the lower limit.

With increase of the iron content, the phase stability decreases (formation of embrittling phases), especially at high chromium contents. Therefore 7% Fe is a practical upper limit for ensuring the phase stability of the alloy according to the invention.

Si is needed during the manufacture of the alloy. Thus a minimum content of 0.001% is necessary. Too high contents again impair the processability and the phase stability, especially at high chromium contents. The Si content is therefore limited to 0.50%.

A minimum content of 0.005% Mn is necessary for the improvement of the processability. Manganese is limited to 2.0%, since this element reduces the oxidation resistance.

Titanium increases the high-temperature resistance. From 1.0%, the oxidation behavior can be greatly impaired, and so 1.0% is the maximum value.

Just as titanium, niobium increases the high-temperature resistance. Higher contents increase the costs very greatly. The upper limit is therefore set at 1.1%.

Even very low Mg contents and/or Ca contents improve the processability by binding sulfur, whereby the occurrence of low-melting NiS eutectics is prevented. Therefore a minimum content of respectively 0.0002% is necessary for Mg and/or Ca. At too high contents, intermetallic Ni—Mg phases or Ni—Ca phases may form, which again greatly impair the processability. The Mg and/or Ca content is therefore limited to at most 0.05%.

A minimum content of 0.005% C is necessary for a good creep resistance. C is limited to a maximum of 0.12%, since above that content this element reduces the processability due to the excessive formation of primary carbides.

A minimum content of 0.001% N is necessary, whereby the processability of the material is improved. N is limited to at most 0.05%, since this element reduces the processability by the formation of coarse carbonitrides.

The oxygen content must be ≤0.020%, in order to ensure manufacturability of the alloy. A too low oxygen content increases the costs. The oxygen content is therefore 0.001%.

The content of phosphorus should be 0.030%, since this surface-active element impairs the oxidation resistance. A too low P content increases the costs. The P content is therefore ≤0.0001%.

The contents of sulfur should be adjusted as low as possible, since this surface-active element impairs the oxidation resistance. Therefore 0.010% S is set as the maximum.

Molybdenum is limited to at most 2.0%, since this element reduces the oxidation resistance.

Tungsten is limited to at most 2.0%, since this element also reduces the oxidation resistance.

The following relationship between Cr and Al must be satisfied, in order that sufficient resistance to metal dusting is achieved:

$$Cr+Al>30 \quad (2a)$$

where Cr and Al are the concentrations of the elements in question in % by mass. Only then is the content of oxide-forming elements high enough to ensure a metal dusting resistance better than Alloy 690.

Furthermore, the following relationship must be satisfied, in order that sufficient phase stability is achieved:

$$Fp \leq 39.9 \text{ with} \quad (3a)$$

$$Fp=Cr+0.272*Fe+2.36*Al+2.22*Si+2.48*Ti+1.26*Nb+0.374*Mo+0.538*W-11.8*C \quad (4a)$$

where Cr, Fe, Al, Si, Ti, Nb, Mo, W and C are the concentrations of the elements in question in % by mass. The limits for Fp as well as possible incorporation of further elements have been substantiated in detail in the foregoing description.

If necessary, the oxidation resistance may be further improved with additions of oxygen-affine elements. They achieve this by being incorporated in the oxide layer and blocking the diffusion paths of the oxygen at the grain boundaries therein.

A minimum content of 0.01% Y is necessary, in order to obtain the oxidation-resistance-increasing effect of the Y. For cost reasons, the upper limit is set at 0.20%.

A minimum content of 0.001% La is necessary, in order to obtain the oxidation-resistance-increasing effect of the La. For cost reasons, the upper limit is set at 0.20%.

A minimum content of 0.001% Ce is necessary, in order to obtain the oxidation-resistance-increasing effect of the Ce. For cost reasons, the upper limit is set at 0.20%.

A minimum content of 0.001% cerium mixed metal is necessary, in order to obtain the oxidation-resistance-increasing effect of the cerium mixed metal. For cost reasons, the upper limit is set at 0.20%.

If necessary, the alloy may also contain Zr. A minimum content of 0.01% Zr is necessary, in order to obtain the high-temperature-resistance-increasing and oxidation-resistance-increasing effect of the Zr. For cost reasons, the upper limit is set at 0.20% Zr.

If necessary, Zr may be replaced completely or partly by Hf, since this element, just as Zr, increases the high-temperature resistance and the oxidation resistance. The replacement is possible starting from contents of 0.001%. For cost reasons, the upper limit is set at 0.20% Hf.

If necessary, the alloy may also contain tantalum, since tantalum also increases the high-temperature resistance. Higher contents raise the costs very greatly. The upper limit is therefore set at 0.60%. A minimum content of 0.001% is necessary in order to achieve an effect.

If necessary, boron may be added to the alloy, since boron increases the creep resistance. Therefore a content of at least 0.0001% should be present. At the same time, this surface-active element impairs the oxidation resistance. Therefore 0.008% boron is set as the maximum.

Cobalt may be present in this alloy up to 5.0%. Higher contents reduce the oxidation resistance markedly.

Copper is limited to at most 0.5%, since this element reduces the oxidation resistance.

Vanadium is limited to at most 0.5%, since this element reduces the oxidation resistance.

Pb is limited to at most 0.002%, since this element reduces the oxidation resistance. The same is true for Zn and Sn.

Furthermore, the following relationship, which describes a particularly good processability, may be satisfied for carbide-forming elements Cr, Ti and C:

$$Fa \leq 60 \text{ with} \quad (5a)$$

$$Fa=Cr+6.15*Nb+20.4*Ti+201*C \quad (6a)$$

where Cr, Nb, Ti and C are the concentrations of the elements in question in % by mass. The limits for Fa have been substantiated in detail in the foregoing description.

Furthermore, the following relationship, which describes a particularly good heat resistance or creep resistance, between the strength-increasing elements may be satisfied:

$$Fk \geq 40 \text{ with} \quad (7a)$$

$$Fk=Cr+19*Ti+34.3*Nb+10.2*Al+12.5*Si+98*C \quad (8a)$$

where Cr, Ti, Nb, Al, Si and C are the concentrations of the elements in question in % by mass. The limits for Fa and the possible incorporation of further elements have been substantiated in detail in the foregoing description.

TABLE 1

Alloys according to ASTM B 168-11 (all values in % by mass)

| Alloy | Ni | Cr | Co | Mo | Nb | Fe | Mn | Al | C | Cu |
|---|---|---|---|---|---|---|---|---|---|---|
| Alloy 600-N06600 | 72.0 min | 14.0-17.0 | | | | 6.0-10.0 | 1.0 max | | 0.15 max | 0.5 max |
| Alloy 601-N06601 | 58.0-63.0 | 21.0-25.0 | | | | Rest | 1.0 max | 1.0-1.7 | 0.10 max | 0.5 max |
| Alloy 617-N06617 | 44.5 min | 20.0-24.0 | 10.0-15.0 | 8.0-10.0 | | 3.0 max | 1.0 max | 0.8-1.5 | 0.05-0.15 | 1.0 max |
| Alloy 690-N06690 | 58.0 min | 27.0-31.0 | | | | 7.0-11.0 | 0.5 max | | 0.05 max | 0.5 max |
| Alloy 693-N06693 | Rest | 27.0-31.0 | | | 0.5-2.5 | 2.5-6.0 | 1.0 max | 2.5-4.0 | 0.15 max | 0.5 max |
| Alloy 602CA-N06025 | Rest | 24.0-26.0 | | | | 8.0-11.0 | 0.15 max | 1.8-2.4 | 0.15-0.25 | 0.1 max |
| Alloy 45-N06045 | 45 min | 26.0-29.0 | | | | 21.0-25.0 | 1.0 max | | 0.05-0.12 | 0.3 max |
| Alloy 603-N06603 | Rest | 24.0-26.0 | | | | 8.0-11.0 | 0.15 max | 2.4-3.0 | 0.20-0.40 | 0.50 max |
| Alloy 696-N06696 | Rest | 28.0-32.0 | | 1.0-3.0 | | 2.0-6.0 | 1.0 max | | 0.15 max | 1.5-3.0 |

| Alloy | Si | S | Ti | P | Zr | Y | B | N | Ce |
|---|---|---|---|---|---|---|---|---|---|
| Alloy 600-N06600 | 0.5 max | 0.015 max | | | | | | | |
| Alloy 601-N06601 | 0.5 max | 0.015 max | | | | | | | |
| Alloy 617-N06617 | 0.5 max | 0.015 max | 0.6 max | | | | 0.006 max | | |
| Alloy 690-N06690 | 1.0 max | 0.015 max | | | | | | | |
| Alloy 693-N06693 | 0.5 max | 0.01 max | 1.0 max | | | | | | |
| Alloy 602CA-N06025 | 0.5 max | 0.010 max | 0.1-0.2 | 0.020 max | 0.01-0.10 | 0.05-0.12 | | | |
| Alloy 45-N06045 | 2.5-3.0 | 0.010 max | | 0.020 max | | | | | 0.03-0.09 |
| Alloy 603-N06603 | 0.5 max | 0.010 max | 0.01-0.25 | 0.020 max | 0.01-0.10 | 0.01-0.15 | | | |
| Alloy 696-N06696 | 1.0-2.5 | 0.010 max | 1.0 max | | | | | | |

TABLE 2

Typical compositions of some alloys according to ASTM B 168-11 (prior art). All values in % by mass
*) Alloy compositions from U.S. Pat. No. 4,882,125 Table 1

| Alloy | Batch | C | S | Cr | Ni | Mn | Si | Mo | Ti | Nb | Cu |
|---|---|---|---|---|---|---|---|---|---|---|---|
| Alloy 600 N06600 | 164310 | 0.07 | 0.002 | 15.75 | 73.77 | 0.28 | 0.32 | | 0.2 | | 0.01 |
| Alloy 601 N06601 | 156656 | 0.053 | 0.0016 | 22.95 | 59.58 | 0.72 | 0.24 | | 0.47 | | 0.04 |
| Alloy 690 N06690 | 111389 | 0.022 | 0.002 | 28.45 | 61.95 | 0.12 | 0.32 | | 0.29 | | 0.01 |
| Alloy 693 N06693 | Alloy 10 *) | 0.015 | ≤0.01 | 29.42 | 60.55 | 0.014 | 0.075 | | 0.02 | 1.04 | 0.03 |
| Alloy 693 N06693 | Alloy 8 *) | 0.007 | ≤0.01 | 30.00 | 60.34 | 0.11 | 0.38 | | 0.23 | 1.13 | 0.03 |
| Alloy 693 N06693 | Alloy 3 *) | 0.009 | ≤0.01 | 30.02 | 57.79 | 0.01 | 0.14 | | 0.02 | 2.04 | 0.03 |
| Alloy 693 N06693 | Alloy 2 *) | 0.006 | ≤0.01 | 30.01 | 60.01 | 0.12 | 0.14 | | 0.01 | 0.54 | 0.03 |
| Alloy 602 N06025 | 163968 | 0.170 | ≤0.01 | 25.39 | 62.12 | 0.07 | 0.07 | | 0.13 | | 0.01 |
| Alloy 603 N06603 | 52475 | 0.225 | 0.002 | 25.20 | 61.6 | 0.09 | 0.03 | | 0.16 | 0.01 | 0.01 |
| Alloy 696 N06696 | UNS average | 0.080 | ≤0.01 | 30.00 | 61.20 | 0.1 | 1.5 | 2 | 0.1 | | 2 |

TABLE 2-continued

Typical compositions of some alloys according to ASTM B 168-11 (prior art). All values in % by mass
*) Alloy compositions from U.S. Pat. No. 4,882,125 Table 1

| Alloy | Batch | Fe | P | Al | Zr | Y | B | $T_{s\ BCC}$ in ° C. | Cr + Al | Fp |
|---|---|---|---|---|---|---|---|---|---|---|
| Alloy 600 N06600 | 164310 | 9.42 | 0.009 | 0.16 | | | 0.001 | | 15.9 | 19.1 |
| Alloy 601 N06601 | 156656 | 14.4 | 0.008 | 1.34 | 0.015 | 0 | 0.001 | 669 | 24.3 | 31.2 |
| Alloy 690 N06690 | 111389 | 8.45 | 0.005 | 0.31 | | 0 | 0 | 720 | 28.8 | 32.7 |
| Alloy 693 N06693 | Alloy 10 *) | 5.57 | | 3.2 | | | 0.002 | 939 | 32.6 | 39.9 |
| Alloy 693 N06693 | Alloy 8 *) | 4.63 | | 3.08 | | | 0.002 | 979 | 33.1 | 41.3 |
| Alloy 693 N06693 | Alloy 3 *) | 5.57 | | 4.3 | | | 0.002 | 1079 | 34.3 | 44.5 |
| Alloy 693 N06693 | Alloy 2 *) | 5.80 | | 3.27 | | | 0.002 | 948 | 33.3 | 40.3 |
| Alloy 602 N06025 | 163968 | 9.47 | 0.008 | 2.25 | 0.08 | 0.08 | 0.005 | 690 | 27.6 | 31.8 |
| Alloy 603 N06603 | 52475 | 9.6 | 0.007 | 2.78 | 0.07 | 0.08 | 0.003 | 707 | 28.0 | 32.2 |
| Alloy 696 N06696 | UNS average | 3 | | | | | | 792 | 30.0 | 35.1 |

TABLE 3a

Composition of the laboratory batches, Part 1. All values in % by mass (T: alloy according to the prior art. E: alloy according to the invention, L: smelted on the laboratory scale: G: industrially smelted)

| | | Name | Batch | C | N | Cr | Ni | Mn | Si | Mo | Ti | Nb |
|---|---|---|---|---|---|---|---|---|---|---|---|---|
| T | G | Alloy 602 CA | 156817 | 0.171 | 0.036 | 25.2 | 62.1 | 0.06 | 0.07 | 0.01 | 0.17 | <0.01 |
| T | G | Alloy 602 CA | 160483 | 0.172 | 0.025 | 25.7 | 62.0 | 0.06 | 0.05 | 0.02 | 0.14 | 0.01 |
| T | G | Alloy 601 | 156656 | 0.053 | 0.018 | 23.0 | 59.6 | 0.72 | 0.24 | 0.04 | 0.47 | 0.01 |
| T | G | Alloy 690 | 80116 | 0.010 | 0.025 | 27.8 | 62.8 | 0.18 | 0.15 | 0.01 | 0.31 | <0.01 |
| T | G | Alloy 690 | 111389 | 0.022 | 0.024 | 28.5 | 62.0 | 0.12 | 0.32 | <0.01 | 0.29 | 0.01 |
| E | L | Cr30TiLa | 2294 | 0.023 | 0.025 | 30.2 | 68.3 | 0.25 | 0.10 | <0.01 | 0.15 | <0.01 |
| E | L | Cr30La | 2295 | 0.020 | 0.020 | 30.0 | 68.7 | 0.25 | 0.10 | <0.01 | <0.01 | <0.01 |
| E | L | Cr30CLa | 2296 | 0.059 | 0.022 | 30.1 | 68.6 | 0.25 | 0.09 | <0.01 | <0.01 | <0.01 |
| E | L | Cr30Al1TiLa | 2298 | 0.018 | 0.022 | 29.9 | 67.5 | 0.25 | 0.08 | <0.01 | 0.30 | <0.01 |
| E | L | Cr30Al1TiNbLa | 2308 | 0.017 | 0.028 | 30.1 | 67.1 | 0.25 | 0.08 | <0.01 | 0.31 | 0.28 |
| E | L | Cr30Al1CLaTi | 2299 | 0.060 | 0.021 | 30.1 | 67.6 | 0.25 | 0.09 | <0.01 | 0.01 | <0.01 |
| E | L | Cr33La | 2303 | 0.019 | 0.020 | 32.9 | 65.7 | 0.25 | 0.09 | <0.01 | <0.01 | <0.01 |
| E | L | Cr33CLa | 2304 | 0.045 | 0.025 | 33.0 | 65.6 | 0.25 | 0.08 | <0.01 | <0.01 | <0.01 |
| E | L | Cr33WCLa | 2314 | 0.054 | 0.026 | 33.1 | 63.7 | 0.25 | 0.12 | <0.01 | <0.01 | <0.01 |
| E | L | Cr33Al1TiLa | 2305 | 0.018 | 0.030 | 32.9 | 64.4 | 0.25 | 0.09 | <0.01 | 0.15 | <0.01 |
| E | L | Cr30C | 250054 | 0.040 | 0.025 | 30.4 | 68.3 | 0.25 | 0.12 | <0.01 | <0.01 | <0.01 |
| E | L | Cr30C | 250053 | 0.040 | 0.022 | 30.5 | 68.7 | 0.25 | 0.12 | <0.01 | <0.01 | <0.01 |
| E | L | Cr30CNLa | 250056 | 0.045 | 0.045 | 30.2 | 68.5 | 0.25 | 0.10 | <0.01 | <0.01 | <0.01 |
| E | L | Cr30Al1Ti | 250060 | 0.017 | 0.027 | 29.6 | 67.9 | 0.24 | 0.11 | <0.01 | 0.31 | <0.01 |
| E | L | Cr30Al1Ti | 250063 | 0.017 | 0.024 | 29.9 | 67.4 | 0.25 | 0.10 | <0.01 | 0.31 | <0.01 |
| E | L | Cr30Al1TiNb | 250066 | 0.016 | 0.022 | 29.9 | 67.1 | 0.24 | 0.09 | <0.01 | 0.31 | 0.31 |
| E | L | Cr30Al1TiNb | 250065 | 0.017 | 0.025 | 30.3 | 67.1 | 0.24 | 0.10 | 0.01 | 0.30 | 0.31 |
| E | L | Cr30Al1TiNbZr | 250067 | 0.019 | 0.020 | 29.7 | 67.2 | 0.25 | 0.10 | 0.02 | 0.31 | 0.31 |
| E | L | Cr30Al1TiNb | 250068 | 0.017 | 0.024 | 29.8 | 66.6 | 0.25 | 0.09 | 0.01 | 0.31 | 0.88 |
| E | L | Cr33C | 250057 | 0.040 | 0.027 | 32.5 | 66.3 | 0.24 | 0.10 | <0.01 | <0.01 | <0.01 |
| E | L | Cr33AlTi | 250079 | 0.018 | 0.024 | 32.7 | 64.8 | 0.25 | 0.10 | <0.01 | 0.15 | <0.01 |
| E | L | Cr33C1Ti | 250139 | 0.083 | 0.027 | 32.5 | 65.8 | 0.27 | 0.07 | <0.01 | 0.17 | <0.01 |
| E | L | Cr33C1Zr | 250140 | 0.081 | 0.028 | 32.7 | 65.7 | 0.26 | 0.07 | 0.01 | <0.01 | 0.01 |
| E | L | Cr33C1 | 250141 | 0.079 | 0.028 | 32.9 | 65.6 | 0.27 | 0.06 | <0.01 | <0.01 | <0.01 |
| E | L | Cr30C1Y | 250143 | 0.081 | 0.022 | 30.5 | 68.1 | 0.27 | 0.05 | <0.01 | <0.01 | 0.01 |
| E | L | Cr30Nb1YC | 250150 | 0.091 | 0.023 | 29.6 | 67.7 | 0.27 | 0.06 | <0.01 | <0.01 | 1.00 |

| | | Name | Batch | Cu | Fe | Al | W | $T_{s\ BCC}$ in ° C. | Cr + Al | Fp |
|---|---|---|---|---|---|---|---|---|---|---|
| T | G | Alloy 602 CA | 156817 | 0.01 | 9.56 | 2.36 | | 683 | 27.6 | 31.9 |
| T | G | Alloy 602 CA | 160483 | 0.01 | 9.44 | 2.17 | | 683 | 27.8 | 31.8 |
| T | G | Alloy 601 | 156656 | 0.04 | 14.41 | 1.34 | 0.01 | 669 | 24.3 | 31.2 |
| T | G | Alloy 690 | 80116 | 0.01 | 8.48 | 0.14 | | 683 | 27.9 | 31.4 |
| T | G | Alloy 690 | 111389 | 0.01 | 8.45 | 0.31 | | 720 | 28.8 | 32.7 |
| E | L | Cr30TiLa | 2294 | <0.01 | 0.56 | 0.26 | 0.01 | 666 | 30.5 | 31.3 |

TABLE 3a-continued

Composition of the laboratory batches, Part 1. All values in % by mass (T: alloy according to the prior art. E: alloy according to the invention, L: smelted on the laboratory scale: G: industrially smelted)

| | | | | | | | | | | |
|---|---|---|---|---|---|---|---|---|---|---|
| E | L | Cr30La | 2295 | <0.01 | 0.54 | 0.28 | <0.01 | 650 | 30.3 | 30.8 |
| E | L | Cr30CLa | 2296 | <0.01 | 0.54 | 0.27 | <0.01 | 637 | 30.3 | 30.3 |
| E | L | Cr30Al1TiLa | 2298 | <0.01 | 0.55 | 1.28 | <0.01 | 759 | 31.2 | 33.8 |
| E | L | Cr30Al1TiNbLa | 2308 | <0.01 | 0.53 | 1.25 | 0.01 | 772 | 31.4 | 34.3 |
| E | L | Cr30Al1CLaTi | 2299 | <0.01 | 0.54 | 1.25 | 0.01 | 730 | 31.3 | 32.7 |
| E | L | Cr33La | 2303 | <0.01 | 0.56 | 0.36 | <0.01 | 739 | 33.3 | 33.9 |
| E | L | Cr33CLa | 2304 | <0.01 | 0.56 | 0.32 | <0.01 | 726 | 33.3 | 33.6 |
| E | L | Cr33WCLa | 2314 | <0.01 | 0.53 | 0.25 | 1.91 | 766 | 33.3 | 34.4 |
| E | L | Cr33Al1TiLa | 2305 | <0.01 | 0.57 | 1.44 | <0.01 | 846 | 34.4 | 36.8 |
| E | L | Cr30C | 250054 | <0.01 | 0.53 | 0.25 | <0.01 | 637 | 30.7 | 30.9 |
| E | L | Cr30C | 250053 | <0.01 | 0.05 | 0.25 | <0.01 | 510 | 30.7 | 30.9 |
| E | L | Cr30CNLa | 250056 | <0.01 | 0.53 | 0.23 | <0.01 | 620 | 30.4 | 30.5 |
| E | L | Cr30Al1Ti | 250060 | <0.01 | 0.54 | 1.16 | 0.01 | 759 | 30.8 | 33.3 |
| E | L | Cr30Al1Ti | 250063 | <0.01 | 0.53 | 1.39 | <0.01 | 759 | 31.3 | 34.2 |
| E | L | Cr30Al1TiNb | 250066 | <0.01 | 0.5 | 1.42 | 0.01 | 772 | 31.3 | 34.5 |
| E | L | Cr30Al1TiNb | 250065 | <0.01 | 0.05 | 1.41 | 0.01 | 768 | 31.7 | 34.8 |
| E | L | Cr30Al1TiNbZr | 250067 | <0.01 | 0.53 | 1.47 | 0.01 | 776 | 31.1 | 34.4 |
| E | L | Cr30Al1TiNb | 250068 | <0.01 | 0.53 | 1.43 | 0.02 | 799 | 31.2 | 35.2 |
| E | L | Cr33C | 250057 | <0.01 | 0.52 | 0.18 | <0.01 | 726 | 32.7 | 32.8 |
| E | L | Cr33AlTi | 250079 | <0.01 | 0.54 | 1.32 | <0.01 | 844 | 34.1 | 36.4 |
| E | L | Cr33C1Ti | 250139 | 0.02 | 0.45 | 0.37 | 0.01 | 734 | 32.9 | 33.1 |
| E | L | Cr33C1Zr | 250140 | 0.03 | 0.46 | 0.32 | 0.01 | 744 | 33.1 | 32.8 |
| E | L | Cr33C1 | 250141 | 0.02 | 0.65 | 0.29 | 0.01 | 719 | 33.2 | 32.9 |
| E | L | Cr30C1Y | 250143 | 0.02 | 0.46 | 0.32 | 0.02 | 630 | 30.8 | 30.5 |
| E | L | Cr30Nb1YC | 250150 | 0.03 | 0.48 | 0.57 | <0.01 | 675 | 30.2 | 31.4 |

TABLE 3b

Composition of the laboratory batches, Part 2. All values in % by mass (The following values apply for all alloys: Pb: max. 0.002%, Zn: max. 0.002%, Sn: max. 0.002%) (see Table 3a for meanings of T, E, G, L)

| | | Name | Batch | S | P | Mg | Ca | V | Zr | Co |
|---|---|---|---|---|---|---|---|---|---|---|
| T | G | Alloy 602 CA | 156817 | 0.002 | 0.005 | 0.004 | 0.001 | 0.03 | 0.08 | 0.05 |
| T | G | Alloy 602 CA | 160483 | <0.002 | 0.007 | 0.01 | 0.002 | — | 0.09 | 0.04 |
| T | G | Alloy 601 | 156656 | 0.002 | 0.008 | 0.012 | <0.01 | 0.03 | 0.015 | 0.04 |
| T | G | Alloy 690 | 80116 | 0.002 | 0.006 | 0.03 | 0.0009 | — | <0.002 | 0.02 |
| T | G | Alloy 690 | 111389 | 0.002 | 0.005 | 0.001 | 0.0005 | — | — | 0.01 |
| E | L | Cr30TiLa | 2294 | 0.002 | 0.003 | 0.012 | <0.01 | <0.01 | 0.002 | <0.001 |
| E | L | Cr30La | 2295 | 0.002 | 0.003 | 0.013 | <0.01 | <0.01 | 0.002 | <0.001 |
| E | L | Cr30CLa | 2296 | 0.003 | 0.003 | 0.015 | <0.01 | <0.01 | <0.002 | <0.001 |
| E | L | Cr30Al1TiLa | 2298 | 0.006 | 0.002 | 0.016 | <0.01 | <0.01 | <0.002 | <0.001 |
| E | L | Cr30Al1TiNbLa | 2308 | 0.002 | 0.002 | 0.014 | <0.01 | <0.01 | <0.002 | 0.001 |
| E | L | Cr30Al1CLaTi | 2299 | 0.003 | 0.002 | 0.015 | <0.01 | <0.01 | <0.002 | <0.001 |
| E | L | Cr33La | 2303 | 0.003 | 0.002 | 0.014 | <0.01 | <0.01 | <0.002 | 0.001 |
| E | L | Cr33CLa | 2304 | 0.002 | 0.002 | 0.013 | <0.01 | <0.01 | <0.002 | 0.001 |
| E | L | Cr33WCLa | 2314 | 0.001 | 0.003 | 0.009 | <0.01 | <0.01 | <0.002 | 0.001 |
| E | L | Cr33Al1TiLa | 2305 | 0.003 | 0.002 | 0.018 | <0.01 | <0.01 | <0.002 | 0.001 |
| E | L | Cr30C | 250054 | 0.003 | 0.002 | 0.007 | <0.01 | <0.01 | <0.002 | <0.001 |
| E | L | Cr30C | 250053 | 0.003 | 0.002 | 0.007 | <0.01 | <0.01 | <0.002 | <0.001 |
| E | L | Cr30CNLa | 250056 | 0.001 | 0.003 | 0.018 | <0.01 | <0.01 | <0.002 | <0.001 |
| E | L | Cr30Al1Ti | 250060 | 0.003 | 0.002 | 0.009 | <0.01 | <0.01 | <0.002 | <0.001 |
| E | L | Cr30Al1Ti | 250063 | 0.003 | 0.003 | 0.012 | <0.01 | <0.01 | <0.002 | <0.001 |
| E | L | Cr30Al1TiNb | 250066 | 0.002 | 0.002 | 0.012 | <0.01 | <0.01 | <0.002 | <0.001 |
| E | L | Cr30Al1TiNb | 250065 | 0.002 | 0.002 | 0.012 | <0.01 | <0.01 | <0.002 | <0.001 |
| E | L | Cr30Al1TiNbZr | 250067 | 0.003 | 0.002 | 0.010 | <0.01 | <0.01 | 0.069 | <0.001 |
| E | L | Cr30Al1TiNb | 250068 | 0.002 | <0.002 | 0.010 | <0.01 | <0.01 | <0.002 | <0.001 |
| E | L | Cr33C | 250057 | 0.004 | 0.002 | 0.008 | <0.01 | <0.01 | <0.002 | <0.001 |
| E | L | Cr33AlTi | 250079 | 0.003 | 0.002 | 0.011 | <0.01 | <0.01 | <0.002 | <0.001 |
| E | L | Cr33C1Ti | 250139 | 0.002 | 0.004 | 0.008 | 0.0002 | <0.01 | 0.002 | <0.01 |
| E | L | Cr33C1Zr | 250140 | 0.003 | 0.004 | 0.007 | 0.0002 | <0.01 | 0.125 | <0.01 |
| E | L | Cr33C1 | 250141 | 0.002 | 0.004 | 0.008 | 0.0002 | <0.01 | 0.007 | <0.01 |
| E | L | Cr30C1Y | 250143 | 0.003 | 0.004 | 0.001 | 0.0002 | <0.01 | 0.003 | <0.01 |
| E | L | Cr30Nb1YC | 250150 | 0.004 | 0.005 | 0.01 | <0.0005 | <0.01 | 0.003 | <0.01 |

| | | Name | Batch | Y | La | B | Hf | Ta | Ce | O |
|---|---|---|---|---|---|---|---|---|---|---|
| T | G | Alloy 602 CA | 156817 | 0.060 | | 0.003 | — | — | — | 0.001 |
| T | G | Alloy 602 CA | 160483 | 0.070 | | 0.003 | — | — | — | 0.001 |
| T | G | Alloy 601 | 156656 | — | | 0.001 | — | — | — | 0.0001 |
| T | G | Alloy 690 | 80116 | — | | 0.002 | — | — | — | 0.0005 |
| T | G | Alloy 690 | 111389 | — | | — | — | — | — | 0.001 |

TABLE 3b-continued

Composition of the laboratory batches, Part 2. All values in % by mass (The following values apply for all alloys: Pb: max. 0.002%, Zn: max. 0.002%, Sn: max. 0.002%) (see Table 3a for meanings of T, E, G, L)

| | | | | | | | | | | |
|---|---|---|---|---|---|---|---|---|---|---|
| E | L | Cr30TiLa | 2294 | — | 0.07 | — | — | <0.005 | 0.001 | 0.0001 |
| E | L | Cr30La | 2295 | — | 0.06 | — | — | <0.005 | 0.001 | 0.0001 |
| E | L | Cr30CLa | 2296 | — | 0.06 | — | — | <0.005 | 0.001 | 0.0001 |
| E | L | Cr30Al1TiLa | 2298 | <0.001 | 0.06 | <0.001 | <0.001 | <0.005 | 0.001 | 0.002 |
| E | L | Cr30Al1TiNbLa | 2308 | <0.001 | 0.09 | <0.001 | <0.001 | <0.005 | 0.001 | 0.002 |
| E | L | Cr30Al1CLaTi | 2299 | <0.001 | 0.06 | <0.001 | <0.001 | <0.005 | 0.001 | 0.002 |
| E | L | Cr33La | 2303 | <0.001 | 0.06 | <0.001 | <0.001 | <0.005 | 0.001 | 0.0001 |
| E | L | Cr33CLa | 2304 | <0.001 | 0.04 | <0.001 | <0.001 | <0.005 | 0.001 | 0.0001 |
| E | L | Cr33WCLa | 2314 | <0.001 | 0.05 | <0.001 | <0.001 | <0.005 | 0.001 | 0.002 |
| E | L | Cr33Al1TiLa | 2305 | <0.001 | 0.05 | <0.001 | <0.001 | <0.005 | 0.001 | 0.0001 |
| E | L | Cr30C | 250054 | <0.001 | — | <0.001 | <0.001 | <0.005 | <0.001 | 0.001 |
| E | L | Cr30C | 250053 | <0.001 | — | <0.001 | <0.001 | <0.005 | <0.001 | 0.003 |
| E | L | Cr30CNLa | 250056 | <0.001 | 0.03 | <0.001 | <0.001 | <0.005 | <0.001 | 0.002 |
| E | L | Cr30Al1Ti | 250060 | <0.001 | — | <0.001 | <0.001 | <0.005 | <0.001 | 0.003 |
| E | L | Cr30Al1Ti | 250063 | <0.001 | — | <0.001 | <0.001 | <0.005 | <0.001 | 0.003 |
| E | L | Cr30Al1TiNb | 250066 | <0.001 | — | <0.001 | <0.001 | <0.005 | <0.001 | 0.004 |
| E | L | Cr30Al1TiNb | 250065 | <0.001 | — | <0.001 | <0.001 | <0.005 | <0.001 | 0.005 |
| E | L | Cr30Al1TiNbZr | 250067 | <0.001 | — | <0.001 | <0.001 | <0.005 | <0.001 | 0.003 |
| E | L | Cr30Al1TiNb | 250068 | <0.001 | — | <0.001 | <0.001 | <0.005 | <0.001 | 0.004 |
| E | L | Cr33C | 250057 | — | — | — | — | <0.005 | <0.001 | 0.003 |
| E | L | Cr33AlTi | 250079 | — | — | — | — | <0.005 | <0.001 | 0.004 |
| E | L | Cr33C1Ti | 250139 | 0.01 | — | <0.0005 | — | — | — | 0.004 |
| E | L | Cr33C1Zr | 250140 | 0.01 | — | 0.001 | — | — | — | 0.003 |
| E | L | Cr33C1 | 250141 | 0.01 | — | 0.001 | — | — | — | 0.005 |
| E | L | Cr30C1Y | 250143 | 0.08 | — | 0.001 | — | — | — | 0.002 |
| E | L | Cr30Nb1YC | 250150 | 0.09 | — | 0.001 | — | — | — | 0.002 |

TABLE 4

Results of the tension tests at room temperature (RT), 600° C. and 800° C. The deformation rate was 8.33 $10^{-5}$ 1/s (0.5%/min) for $R_{p0.2}$ and 8.33 $10^{-4}$ 1/s (5%/min) for $R_m$; KG = grain size, *) specimen defective.

| | | Name | Batch | KG in µm | $R_{p0.2}$ in MPa RT | $R_m$ in MPa RT | $A_s$ in % RT | $R_{p0.2}$ in MPa 600° C. | $R_m$ in MPa 600° C. | $A_s$ in % 600° C. | $R_{p0.2}$ in MPa 800° C. | $R_m$ in MPa 800° C. | Fa | Fk |
|---|---|---|---|---|---|---|---|---|---|---|---|---|---|---|
| T | G | Alloy 602 CA | 156817 | 76 | 292 | 699 | 36 | 256 | 578 | 41 | 186 | 198 | 63.0 | 76.9 |
| T | G | Alloy 602 CA | 160483 | 76 | 340 | 721 | 42 | 254 | 699 | 69 | | | 62.2 | 75.0 |
| T | G | Alloy 601 | 156656 | 136 | 238 | 645 | 53 | 154 | 509 | 55 | 133 | 136 | 63.2 | 56.3 |
| T | G | Alloy 690 | 80116 | 92 | 279 | 641 | 56 | 195 | 469 | 48 | 135 | 154 | 43.3 | 41.6 |
| T | G | Alloy 690 | 111389 | 72 | 285 | 630 | 50 | 186 | 465 | 51 | | | 36.2 | 43.6 |
| E | L | Cr30TiLa | 2294 | 161 | 285 | 537 | *) | 170 | 452 | 29 | 145 | 171 | 38.0 | 39.6 |
| E | L | Cr30La | 2295 | 189 | 225 | 555 | *) | 131 | 358 | 26 | 110 | 167 | 34.0 | 36.0 |
| E | L | Cr30CLa | 2296 | 237 | 295 | 644 | 59 | 197 | 472 | 57 | 192 | 200 | 41.9 | 39.7 |
| E | L | Cr30Al1TiLa | 2298 | 94 | 351 | 704 | 59 | 228 | 490 | 31 | 149 | 161 | 39.7 | 51.6 |
| E | L | Cr30Al1TiNbLa | 2308 | 90 | 288 | 683 | 55 | 200 | 508 | 39 | 174 | 181 | 41.6 | 61.0 |
| E | L | Cr30Al1CLaTi | 2299 | 253 | 258 | 661 | 62 | 212 | 475 | 59 | 181 | 185 | 42.3 | 50.0 |
| E | L | Cr33La | 2303 | 145 | 272 | 618 | *) | 137 | 433 | 57 | 118 | 171 | 36.7 | 39.6 |
| E | L | Cr33La | 2304 | 278 | 284 | 640 | 50 | 171 | 439 | 65 | 168 | 209 | 42.1 | 41.7 |
| E | L | Cr33WCLa | 2314 | 298 | 254 | 644 | 66 | 143 | 438 | 67 | 154 | 212 | 43.9 | 42.4 |
| E | L | Cr33Al1TiLa | 2305 | 68 | 276 | 623 | *) | 224 | 472 | 41 | 161 | 166 | 39.6 | 53.3 |
| E | L | Cr30C | 250054 | 207 | 227 | 628 | 63 | 127 | 428 | 64 | 147 | 196 | 38.5 | 36.4 |
| E | L | Cr30C | 250053 | 150 | 215 | 526 | 55 | 119 | 426 | 57 | 128 | 187 | 38.5 | 38.5 |
| E | L | Cr30CNLa | 250056 | 242 | 234 | 612 | 55 | 145 | 440 | 74 | 144 | 204 | 39.3 | 38.2 |
| E | L | Cr30Al1Ti | 250060 | 114 | 252 | 662 | 67 | 183 | 509 | 62 | 143 | 154 | 39.3 | 50.4 |
| E | L | Cr30Al1Ti | 250063 | 116 | 252 | 659 | 70 | 178 | 510 | 57 | 148 | 1521 | 39.6 | 52.9 |
| E | L | Cr30Al1TiNb | 250066 | 121 | 240 | 666 | 67 | 186 | 498 | 66 | 245 | 255 | 41.4 | 63.6 |
| E | L | Cr30Al1TiNb | 250065 | 132 | 285 | 685 | 61 | 213 | 521 | 58 | 264 | 265 | 41.8 | 64 |
| E | L | Cr30Al1TiNbZr | 250067 | 112 | 287 | 692 | 67 | 227 | 532 | 65 | 280 | 280 | 41.6 | 64.2 |
| E | L | Cr30Al1TiNb | 250068 | 174 | 261 | 665 | 69 | 205 | 498 | 65 | 297 | 336 | 44.9 | 83.2 |
| E | L | Cr33C | 250057 | 191 | 241 | 638 | 66 | 127 | 414 | 54 | 185 | 197 | 40.6 | 39.5 |
| E | L | Cr33AlTi | 250079 | 101 | 267 | 665 | 68 | 190 | 489 | 56 | 145 | 164 | 39.4 | 52.0 |
| E | L | Cr33C1Ti | 250139 | 112 | 266 | 679 | 54 | 161 | 495 | 46 | 167 | 187 | 52.7 | 48.5 |
| E | L | Cr33C1Zr | 250140 | 153 | 269 | 667 | 60 | 177 | 447 | 36 | 164 | 191 | 49.1 | 47.4 |
| E | L | Cr33C1 | 250141 | 302 | 269 | 645 | 58 | 157 | 430 | 62 | 192 | 214 | 48.8 | 46.6 |
| E | L | Cr30C1Y | 250143 | 195 | 264 | 650 | 69 | 166 | 490 | 60 | 174 | 195 | 46.8 | 44.9 |
| E | L | Cr30Nb1YC | 250150 | 72 | 287 | 722 | 53 | 188 | 577 | 57 | 181 | 194 | 54.0 | 81.6 |

TABLE 5

Results of the oxidation tests at 1000° C. in air after 1056 h.

| | | Name | Batch | Test No. | $m_{gross}$ in g/m$^2$ | $m_{net}$ in g/m$^2$ | $m_{spall}$ in g/m$^2$ |
|---|---|---|---|---|---|---|---|
| T | G | Alloy 602 CA | 160483 | 412 | 8.66 | 7.83 | 0.82 |
| T | G | Alloy 602 CA | 160483 | 425 | 5.48 | 5.65 | −0.18 |
| T | G | Alloy 601 | 156125 | 403 | 51.47 | 38.73 | 12.74 |
| T | G | Alloy 690 | 111389 | 412 | 23.61 | 7.02 | 16.59 |
| T | G | Alloy 690 | 111389 | 421 | 30.44 | −5.70 | 36.14 |
| T | L | Alloy 690 | 111389 | 425 | 28.41 | −0.68 | 29.09 |
| E | L | Cr30TiLa | 2294 | 412 | 28.40 | −18.37 | 46.77 |
| E | L | Cr30La | 2295 | 412 | 19.44 | 0.09 | 19.35 |
| E | L | Cr30CLa | 2296 | 412 | 26.83 | −11.43 | 38.27 |
| E | L | Cr30Al1TiLa | 2298 | 412 | 49.02 | −30.59 | 79.61 |
| E | L | Cr30Al1TiNbLa | 2308 | 412 | 42.93 | −15.54 | 58.47 |
| E | L | Cr30Al1CLaTi | 2299 | 412 | 30.51 | 0.08 | 30.44 |
| E | L | Cr33La | 2303 | 412 | 25.98 | −8.42 | 34.40 |
| E | L | Cr33CLa | 2304 | 412 | 29.18 | −14.42 | 43.60 |
| E | L | Cr33WCLa | 2314 | 412 | 24.37 | −10.35 | 34.72 |
| E | L | Cr33Al1TiLa | 2305 | 412 | 49.96 | −19.36 | 69.32 |
| E | L | Cr30C | 250054 | 421 | 31.15 | −21.76 | 52.92 |
| E | L | Cr30C | 250053 | 421 | 31.37 | −26.58 | 57.95 |
| E | L | Cr30CNLa | 250056 | 421 | 23.46 | −9.64 | 33.11 |
| E | L | Cr30Al1Ti | 250060 | 421 | 43.30 | −19.88 | 63.17 |
| E | L | Cr30Al1Ti | 250063 | 421 | 32.81 | −22.15 | 54.96 |
| E | L | Cr30Al1TiNb | 250066 | 421 | 26.93 | −16.35 | 43.28 |
| E | L | Cr30Al1TiNb | 250065 | 421 | 25.85 | −24.27 | 50.12 |
| E | L | Cr30Al1TiNbZr | 250067 | 421 | 41.59 | −15.56 | 57.16 |
| E | L | Cr30Al1TiNb | 250068 | 421 | 42.69 | −39.26 | 81.95 |
| E | L | Cr33C | 250057 | 421 | 34.72 | −47.71 | 82.43 |
| E | L | Cr33AlTi | 250079 | 421 | 17.02 | 1.99 | 15.03 |
| E | L | Cr33C1Ti | 250139 | 425 | 57.97 | −49.60 | 107.58 |
| E | L | Cr33C1Zr | 250140 | 425 | 23.83 | 7.22 | 16.60 |
| E | L | Cr33C1 | 250141 | 425 | 37.63 | −28.71 | 66.35 |
| E | L | Cr30C1Y | 250143 | 425 | 25.78 | −1.85 | 27.63 |
| E | L | Cr30Nb1YC | 250150 | 425 | 27.70 | −10.02 | 37.72 |

LIST OF REFERENCE NUMBERS

FIG. 1 Metal loss due to metal dusting as a function of the aluminum and chromium content in a strongly carburizing gas with 37% Co, 9% $H_2O$, 7% $CO_2$, 46% $H_2$, which has $a_c$=163 and $p(O_2)=2.5\cdot10^{-27}$. (from Hermse, C. G. M. and van Wortel, J. C.: Metal dusting: relationship between alloy composition and degradation rate. Corrosion Engineering, Science and Technology 44 (2009), p. 182-185).

Figure 2:
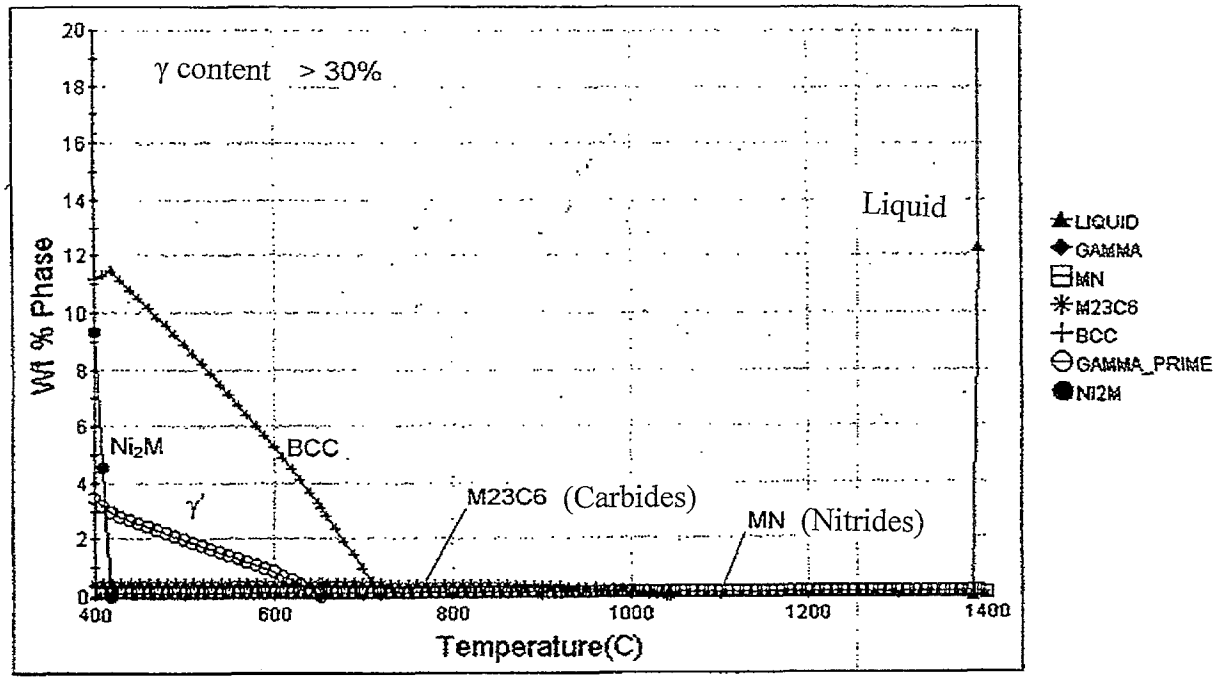

FIG. 2 Proportions of the phases in thermodynamic equilibrium as a function of the temperature of Alloy 690 (N06690) on the example of the typical batch 111389.

FIG. 3 Proportions of the phases in thermodynamic equilibrium as a function of the temperature of Alloy 693 (N06693) on the example of Alloy 3 from Table 2.

FIG. 4 Proportions of the phases in thermodynamic equilibrium as a function of the temperature of Alloy 693 (N06693) on the example of Alloy 10 from Table 2.

The invention claimed is:

1. Nickel-chromium alloy with (in % by wt) 31 to 37% chromium, 0.001 to 1.8% aluminum, 0.10 to 7.0% iron, 0.001 to 0.50% silicon, 0.005 to 2.0% manganese, 0.00 to 1.00% titanium and 0.10 to 1.10% niobium, respectively 0.0002 to 0.05% magnesium and/or calcium, 0.005 to 0.12% carbon, 0.001 to 0.050% nitrogen, 0.001 to 0.030% phosphorus, 0.0001-0.020% oxygen, max. 0.010% sulfur, max. less than 0.5% molybdenum, max. less than 0.5% tungsten, the rest nickel and the usual process-related impurities, wherein the following relationships must be satisfied:

$$Cr+Al>30 \quad (2a)$$

$$\text{and } Fp\leq 36.6 \text{ with} \quad (3a)$$

$$Fp=Cr+0.272*Fe+2.36*Al+2.22*Si+2.48*Ti+1.26*Nb+0.374*Mo+0.538*W-11.8*C \quad (4a)$$

where Cr, Fe, Al, Si, Ti, Nb, C, W and Mo are the concentrations of the elements in question in % by mass, and wherein the following formula is satisfied:

$$Fa\leq 60 \quad (5a)$$

$$\text{with } Fa=Cr+6.15*Nb+20.4*Ti+201*C \quad (6a)$$

where Cr, Ti, Nb and C are the concentrations of the elements in question in % by mass.

2. Alloy according to claim 1, with a chromium content >32-37%.

3. Alloy according to claim 1, with an aluminum content of 0.001 to 1.4%.

4. Alloy according to claim 1, with an iron content of 0.1 to 4.0%.

5. Alloy according to claim 1, with a silicon content of 0.001 to 0.2%.

6. Alloy according to claim 1, with a manganese content of 0.005 to 0.50%.

7. Alloy according to claim 1, with a titanium content of 0.001 to 0.60%.

8. Alloy according to claim 1, with a niobium content of 0.10 to 1.0%.

9. Alloy according to claim 1, with a carbon content of 0.01 to 0.12%.

10. Alloy according to claim 1, further containing yttrium with a content of 0.01 to 0.20%.

11. Alloy according to claim 1, further containing lanthanum with a content of 0.001 to 0.20%.

12. Alloy according to claim 1, further containing cerium with a content of 0.001 to 0.20%.

13. Alloy according to claim 12, with a content of cerium mixed metal of 0.001 to 0.20%.

14. Alloy according to claim 1, further containing zirconium with a content of 0.01 to 0.20%.

15. Alloy according to claim 14, in which the zirconium is substituted completely or partly by 0.001 to 0.20% hafnium.

16. Alloy according to claim 1, further containing boron with a content of 0.0001 to 0.008%.

17. Alloy according to claim 1, further containing 0.00 to 5.0% cobalt.

18. Alloy according to claim 1, further containing at most 0.5% copper if necessary, wherein Formula 4a is supplemented by a term with Cu:

$$Fp=Cr+0.272*Fe+2.36*AI+2.22*Si+2.48*Ti+1.26*Nb+0.477*Cu+0.374*Mo+0.538*W-11.8*C \quad (4b)$$

and Cr, Fe, Al, Si, Ti, Nb, Cu, W and Mo are the concentrations of the elements in question in % by mass.

19. Alloy according to claim 1, further containing at most 0.5% vanadium.

20. Alloy according to claim 1, wherein the impurities are adjusted in contents of max. 0.002% Pb, max. 0.002% Zn, max. 0.002% Sn.

21. Alloy according to claim 1, wherein the following formula is satisfied:

$$Fk \geq 40 \quad (7a)$$

$$\text{with } Fk=Cr+19*Ti+34.3*Nb+10.2*Al+12.5*Si+98*C \quad (8a)$$

for an alloy without B, where Cr, Ti, Nb, Al, Si and C are the concentrations of the elements in question in % by mass, $$\text{or with } Fk=Cr+19*Ti+34.3*Nb+10.2*Al+12.5*Si+98*C+2245*B \quad (8b)$$

for an alloy with B, where Cr, Ti, Nb, Al, Si, C and B are the concentrations of the elements in question in % by mass.

* * * * *